US009643439B2

(12) United States Patent
Vellutato, Jr.

(10) Patent No.: US 9,643,439 B2
(45) Date of Patent: May 9, 2017

(54) PORTABLE CLEANROOM PRINTING CABINET

(71) Applicant: Veltek Associates, Inc., Malvern, PA (US)

(72) Inventor: Arthur Vellutato, Jr., West Chester, PA (US)

(73) Assignee: Veltek Associates, Inc., Malvern, PA (US)

( * ) Notice: Subject to any disclaimer, the term of this patent is extended or adjusted under 35 U.S.C. 154(b) by 0 days.

(21) Appl. No.: 14/797,319

(22) Filed: Jul. 13, 2015

(65) Prior Publication Data

US 2016/0023491 A1 Jan. 28, 2016

Related U.S. Application Data

(63) Continuation-in-part of application No. 14/033,045, filed on Sep. 20, 2013.

(51) Int. Cl.

| | |
|---|---|
| ***B41J 29/12*** | (2006.01) |
| ***B41J 29/13*** | (2006.01) |
| ***B41J 29/377*** | (2006.01) |
| ***B65H 31/00*** | (2006.01) |
| ***A47B 31/02*** | (2006.01) |
| ***A47B 81/00*** | (2006.01) |
| ***B41J 29/06*** | (2006.01) |

(52) U.S. Cl.

CPC ..... *B41J 29/377* (2013.01); *A47B 31/02* (2013.01); *A47B 81/00* (2013.01); *B41J 29/06* (2013.01); *B41J 29/12* (2013.01); *B41J 29/13* (2013.01); *B65H 31/00* (2013.01)

(58) Field of Classification Search

CPC ... B41J 29/12; B41J 29/13; B41J 29/08; B41J 29/377

See application file for complete search history.

(56) References Cited

U.S. PATENT DOCUMENTS

| | | | | |
|---|---|---|---|---|
| 3,062,109 | A | 11/1962 | Mayo | |
| 3,476,210 | A * | 11/1969 | Carlson | H04L 13/02 178/42 |
| 4,700,838 | A | 10/1987 | Falciani et al. | |
| 4,729,452 | A * | 3/1988 | Sims | B41J 29/08 181/201 |
| 5,056,331 | A * | 10/1991 | Lotz | B41J 29/13 165/80.3 |
| 5,281,027 | A | 1/1994 | Thrall | |

(Continued)

FOREIGN PATENT DOCUMENTS

| | | |
|---|---|---|
| EP | 0238802 A1 | 9/1987 |
| FR | 2581930 A1 | 11/1986 |

(Continued)

OTHER PUBLICATIONS

International Search Report issued in PCT/US2014/056499 dated Dec. 30, 2014.

*Primary Examiner* — Daniel J Colilla
(74) *Attorney, Agent, or Firm* — Blank Rome LLP

(57) ABSTRACT

A portable printing cabinet having a housing with a substantially enclosed interior and an opening formed in a side surface thereof, a printing device located within the interior of said housing, and a paper tray positioned outside of the housing and in communication with the opening of the housing is provided.

17 Claims, 4 Drawing Sheets

(56) References Cited

U.S. PATENT DOCUMENTS

| | | | | |
|---|---|---|---|---|
| 6,112,989 | A * | 9/2000 | Sheldon | G07B 1/00 235/382 |
| 6,123,900 | A | 9/2000 | Vellutato | |
| 6,333,006 | B1 | 12/2001 | Vellutato | |
| 6,607,698 | B1 | 8/2003 | Spears et al. | |
| 2002/0146631 | A1 | 10/2002 | Nakamura et al. | |
| 2002/0175105 | A1 | 11/2002 | Suzuura et al. | |
| 2003/0206825 | A1 | 11/2003 | Vellutato | |
| 2005/0275157 | A1 * | 12/2005 | Mindler | B65H 31/22 271/207 |
| 2006/0067778 | A1 * | 3/2006 | Bhatia | B41J 29/13 400/693 |
| 2007/0084145 | A1 | 4/2007 | Scheerer | |
| 2011/0252897 | A1 | 10/2011 | Swenson et al. | |
| 2011/0317817 | A1 * | 12/2011 | Nishino | A61B 6/4405 378/102 |
| 2016/0023491 | A1 | 1/2016 | Vellutato, Jr. | |

FOREIGN PATENT DOCUMENTS

| | | | | |
|---|---|---|---|---|
| JP | 60220779 | A | * | 11/1985 |
| JP | 02214682 | A | * | 8/1990 |
| JP | 08058190 | A | | 3/1996 |
| JP | 2001260480 | A | * | 9/2001 |
| JP | 2006068966 | A | * | 3/2006 |
| JP | 2006215309 | A | | 8/2006 |

* cited by examiner

PORTABLE CLEANROOM PRINTING CABINET

CROSS-REFERENCE TO RELATED APPLICATION

The invention is a continuation-in-part of co-pending U.S. patent application Ser. No. 14/033,045, filed Sep. 20, 2013, the disclosure of which is hereby incorporated by reference.

FIELD OF THE INVENTION

The invention relates to a portable printing cabinet for use in a sterile environment. In particular, the invention provides a multi-compartment printing unit that can be used in a cleanroom without introducing outside contaminants such as particulates and microorganisms.

BACKGROUND OF THE INVENTION

Sterile "cleanroom" environments demand that any person or item entering the room be free of a certain level of contaminants. Sterilized environments are most commonly designed for use in manufacturing facilities and medical research and treatment facilities in the pharmaceutical, biotechnology, and healthcare industries, to name a few. Sterile cleanroom environments may be classified under a variety of classification schemes, including the International Organization of Standardization ("ISO") Cleanroom Standards, whereby the highest level of sterilization is an ISO 1 cleanroom, and normal ambient air (no sterilization) is classified as ISO 9. The ISO standards correspond to the allowed number of particles having a minimum particle size per cubic meter. For example, an ISO 5 cleanroom allows the following: a maximum of 100,000 particles with a particle size greater than 0.1 μm; a maximum of 23,700 particles greater than 0.2 μm; a maximum of 10,200 particles greater than 0.3 μm; a maximum of 3,520 particles greater than 0.5 μm; a maximum of 832 particles greater than 1 μm; and a maximum of 29 particles greater than 5 μm.

A variety of products are utilized inside cleanroom environments, including paper and paper products used to document manufacturing and testing records within the controlled areas. Such paper products include, but are not limited to, forms, logbooks, tags and batch records. All of these documents are necessary to detail the manufacturing and testing processes so as to ensure that proper procedures are followed and results are documented. Indeed, these documents are subject to review by regulatory agencies, such as the U.S. Food and Drug Administration, and represent the mechanism by which such agencies can review the manufacturing and testing process details after the manufacture, testing, or handling of a drug product, for example, to assure patient safety.

However, paper and paper products are a significant contamination source due to shedding fibers, particulates and microorganisms (e.g., bacillus and mold). About 40% of paper products used in sterile environments are standard documents that can be pre-printed, packaged and sterilized by known means. However, the remainder of the documents introduced into sterile environments cannot be pre-printed, sterilized and packaged in a timely fashion. Their preparation requires information that is not readily available until days, or even hours, before the manufacturing or testing is to begin. In some instances, they must be prepared while manufacturing and/or testing is underway. Because of this, these documents are forced to be brought into sterilized areas without prior treatment for the reduction of shedding fibers, particulates and microorganisms. Thus, they represent a significant contamination source.

To solve this problem, the invention provides for a portable cleanroom printing cabinet which allows documents to be printed in sterile environments without the introduction of any outside contaminants.

SUMMARY OF THE INVENTION

Accordingly, the invention provides a portable printing cabinet which includes a housing having a substantially enclosed interior and an opening formed in a side surface thereof, a printing device located within the interior of said housing, and a paper tray positioned outside of the housing and in communication with the opening of the housing.

The invention further provides a portable printing cabinet which includes a housing having a substantially enclosed interior and an opening formed in a side surface thereof, an interior shelf located within the housing defining an upper portion and a lower portion of the cabinet, wherein the upper portion has a top surface with a step-up portion, a printing device located on the interior shelf, a paper tray positioned outside of the housing and in communication with the opening of the housing, at least one L-shaped hinged cover that forms part of the step-up portion of the top surface of the upper portion of the housing, a second hinged cover fixed to the top surface of the upper portion of the housing adjacent to the step-up portion, at least one air filtration unit located within the housing having vents positioned on an outside surface of the housing, and at least one power source.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1:
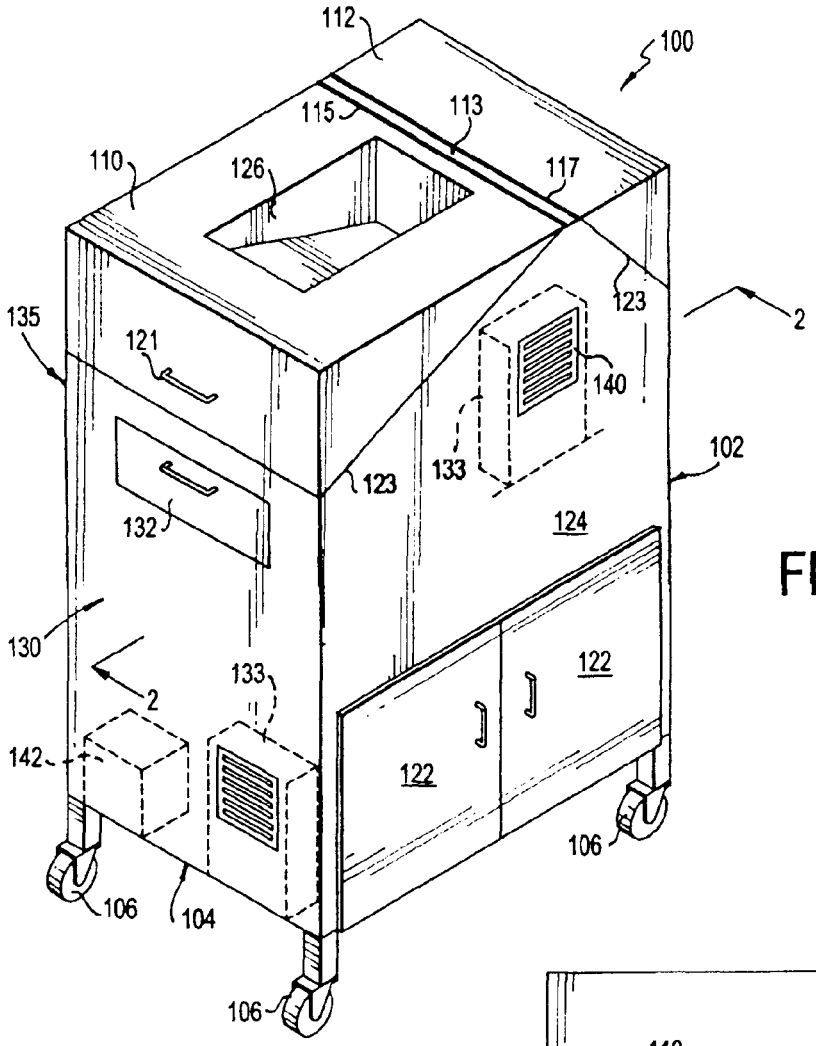
FIG. 1 is a perspective view of a portable printing cabinet in accordance with an exemplary embodiment of the invention.
Figure 3:
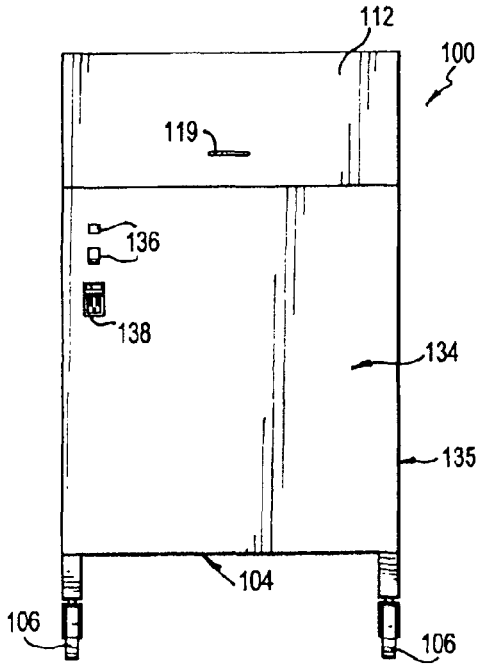
FIG. 3 is a side elevational view of the portable printing cabinet illustrated in FIG. 1.
Figure 2:
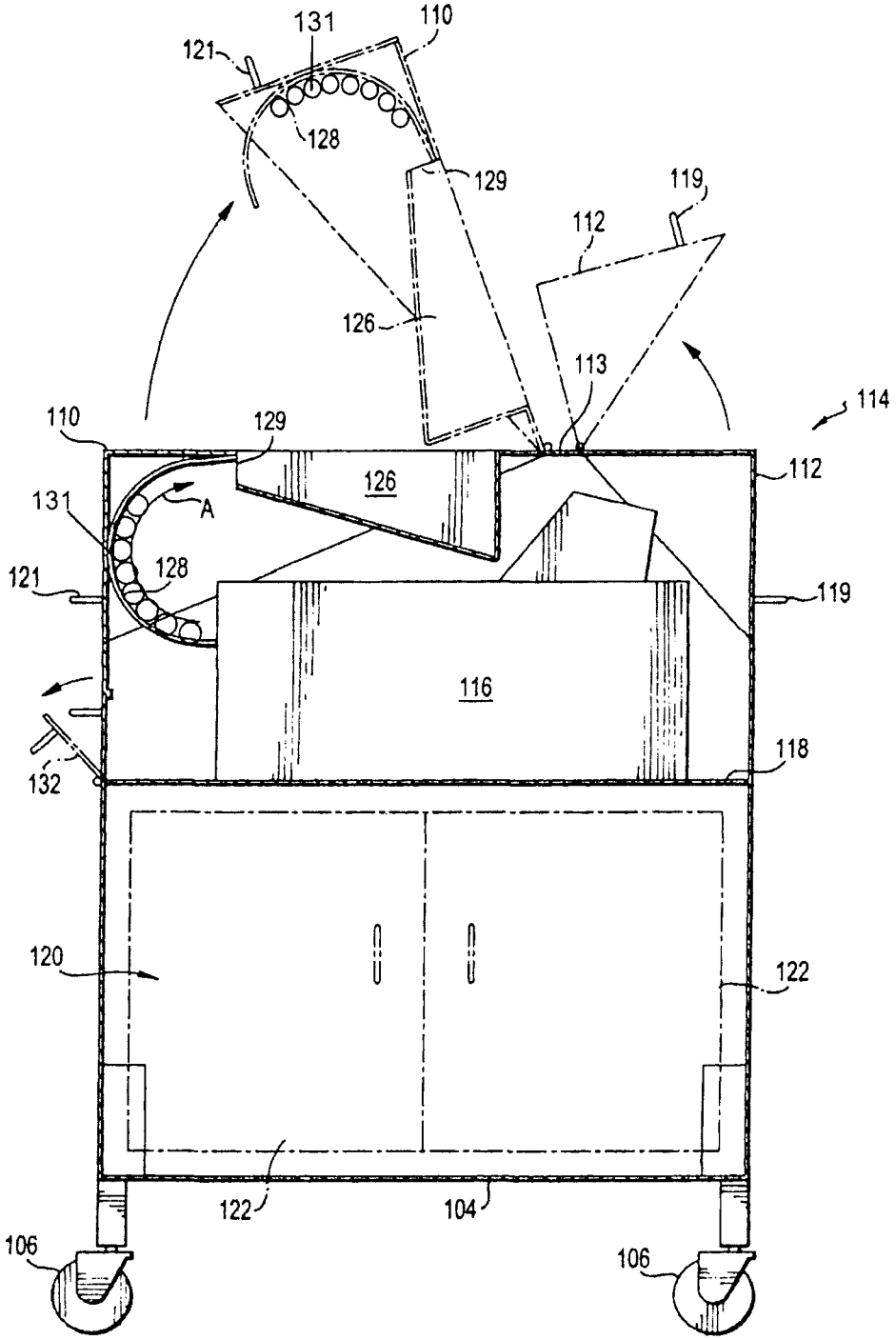
FIG. 2 is a front sectional view of the portable printing cabinet illustrated in FIG. 1 taken along line 2-2.

Referring to FIGS. 1-3, the portable printing cabinet 100 of the invention allows the printing of documents within a controlled, cleanroom environment onto sterilized paper at high speeds. This cabinet reduces or eliminates the presence of bioburden (e.g., microorganisms such as bacillus and mold) on printed documents. The printing cabinet 100 further assures that particulates and shedding fibers from the paper is minimized or eliminated. The printing cabinet 100 of the invention may be used in any ISO level controlled area, including cleanrooms at an ISO 5 level or lower.

As shown in FIG. 1, the printing cabinet 100 generally includes a housing 102 having at least four sides and a bottom 104. In the embodiment shown, the four sides are formed of thin rectangular-shaped panels and include a left side 130, front side 124, right side 134, and back side 135. The sides 124, 130, 134 and 135 are preferably joined with the bottom 104 of the housing 102 to form a substantially rectangular box-shaped cabinet 100. Preferably, the housing 102 forms an enclosure that defines an interior space. Cross-member 113 may connect the front side 124 of the housing 102 to the back side 135 of the housing 102. The cabinet 100 may be supported by any structure known in the art. As shown in FIG. 1, the cabinet 100 is supported by a plurality of wheels 106 fixed to the bottom 104. The use of wheels 106 allows the cabinet 100 to be moved out of the cleanroom when necessary for cleaning or sterilization treatment. Legs may also be used if the cabinet 100 does not need to be moved from one location to another.

The housing 102 may be formed of any durable material which can store a printing device and other items, and which prevents the passage of fluids or air into the interior of the cabinet 100. Indeed, the housing 102 preferably forms a sealed unit (with covers 110 and 112) such that contaminants cannot escape. According to one embodiment, the entire housing 102 is formed of stainless steel. According to another embodiment, other durable metals or plastic materials may be used. Metals are preferred such that sterilization of the unit can be performed by an autoclave or other similar devices.

Referring now to FIG. 2, a cross-section is shown of the printing cabinet 100 taken along line 2-2 of FIG. 1. An interior shelf 118 may be provided that divides the cabinet 100 into an upper portion 114 and a lower portion 120. In one embodiment, the interior shelf 118 is welded to sides 124, 130, 134 and 135 of the housing 102 to form a complete assembly. The upper portion 114 houses a printing device 116, which can be placed on the interior shelf 118. Any printing device known in the art may be used. High-grade printers which emit the lowest level of particulates, reduce shedding, and reduce ink droplet release, are preferred. According to one embodiment, the CDT 1600S printer manufactured by Colordyne Technologies LLC of Brookfield, Wis., which may include MEMJET® printing technology, may be used. However, it will be appreciated that any suitable or standard printer can be utilized within the scope of the invention.

The upper portion 114 of the cabinet 100 may also house an air filtration unit 133 having a fan aligned with exterior vents 140 positioned on at least one side of the housing 102 (see FIG. 1). Any filtration unit known in the art may be used, though preferable that the unit achieves a filtration rate of 99.97%. More specifically, the unit 133 must filter air from the interior of the cabinet 100 at a rate of 99.97% with respect to 0.5 micron particles. According to one embodiment, a high-efficiency particulate air ("HEPA") filtration unit may be used. The fan of the air filtration unit 133 blows air out of the cabinet through the filter. This maintains the cabinet 100 under negative pressure, via the exterior vents 140, such that the risk of transmission of particles to the exterior environment is minimized. Thus, if a door 122 or 132, or a cover 110 or 112, is opened, the fan will suck air into the housing interior, preventing particles from escaping. In addition, the interior shelf 118 may have vents (not shown) which permit equalization of the pressure in the cabinet 100 between the upper portion 114 and the lower portion 120.

According to a preferred embodiment, at least one hinged cover is fixed to the housing 102 of the cabinet 100 so as to enclose the upper portion 114 and still allow for easy access to the interior of the housing 102, such as to access the printing device 116. As shown in FIG. 1, the upper portion 114 is enclosed by two adjacent hinged covers 110 and 112 having a generally triangular cross-section. Specifically, hinged covers 110 and 112 may each have angled edges 123 which engage the front side 124 and back side 135 of the housing 102. The front cover 110 may be hinged to cross-member 113 of the housing 102 along one lateral side 115 that extends transversely across from side 124 to side 134. Any method of hinging one member to another member may be used, including piano style mechanical hinges or the inclusion of a polymer strip (e.g., polypropylene) between the cover 110 and the cross-member 113 along side 115. While the air filtration unit 133 adequately maintains the interior of the cabinet 100 under negative pressure so as to minimize the risk of contamination, gaskets or rubber seals may optionally be utilized between the hinged covers 110 and 112 and the housing 102 (on any side) to further ensure contamination protection.

The front cover 110 may include a paper tray 126 on an outer surface for receiving printed documents. In another embodiment, the paper tray 126 need not be on the front cover 110, but may be separate from the housing 102 and attached thereto. Alternatively, the printed paper may be ejected from an opening in the housing 102 located on any side adjacent to the end of the printing device 116 (see FIGS. 4 and 5A-B).

As seen in FIG. 2, the printing device 116 may include a paper guide 128 extending from an end thereof. The paper guide 128 may be a C-shaped paper dispensing guide having a plurality of rollers 131 along its length. In one embodiment, the paper guide 128 is a half circle with a radius of between 3 and 8 inches, such that a variety of paper sizes may be accommodated. When the printed paper is expelled from the printing device 116, it is moved along by the rollers 131 on the paper guide 128 in direction "A." The paper guide 128 guides the paper upward to be received in the paper tray 126, which is then accessible without needing to lift the front cover 110 to access the printing device 116. In this way, the paper guide 128 transfers the paper from the printing device 116, inside of the housing 102, to the paper tray 126, outside of the housing 102. The printed paper should be ejected from the printing device 116 with a force sufficient to push the paper along the rollers 131 of the paper guide 128 and deposited into paper tray 126 above. In one embodiment, a gear-driven assembly having a motor (not shown) may be used to rotate the rollers to thereby push or pull the printed paper along the paper guide 128. The front cover 110 includes an opening 129 in communication with the paper tray 126 so as to allow the printed paper to pass through. Specifically, the paper guide 128 is connected to the top of the opening 129 in the front cover 110 such that the paper can be deposited into the paper tray 126 on top of any paper previously printed. The front cover 110 only needs to be lifted if the printing device 116 experiences a paper jam or lodged paper needs to be removed from the paper guide 128. The front cover 110 may include a handle 121 designed for use by an individual wearing a protective glove.

The rear cover 112 may be configured similarly to the front cover 110. The rear cover 112 may be used to feed paper into the printing device 116. Specifically, the rear cover 112 may be hinged to cross-member 113 of the housing 102 along a lateral side 117 opposite the side connected to the front cover 110. The hinging mechanism may be similar to those used with the front cover 110, as discussed above. The rear cover 112 may have a handle 119, which is designed for use by an individual wearing a protective glove. The opened first and second covers 110 and 112, respectively, are illustrated in FIG. 2.

The left side 130 of the housing 102 may include one or more doors 132 (one is illustrated in FIG. 1) for access to the printing device 116 and upper portion 114 of the printing cabinet 100. Specifically, while not limited to such an embodiment, the door 132 may be used for printer cartridge replacement. Because high-quality printing devices are preferred according to the invention, numerous printing cartridges may need to be used and replaced often. The user may access the printing device 116 to replace printing cartridges by opening the door 132, as shown in FIG. 2. While the door 132 is depicted on the left side 130 of the cabinet 100 in FIGS. 1 and 2, it may be positioned on any side of the cabinet 100 which allows access to the printing device 116 (e.g., front side 124). Like the front and rear covers 110 and 112, respectively, gaskets or rubber seals may optionally be utilized between door 132 and the housing 102 to further ensure contamination protection.

As shown in FIG. 3, the right side 134 of the housing 102 may include ports for the connection of a data cable and/or power cable. Specifically, two data connection ports 136 and one power outlet 138 are shown, although any number of ports may be present for various purposes. According to another embodiment, the ports 136 and outlet 138 may be provided on any side of the cabinet 100. The data connection ports 136 and outlet 138 may be present on both the outside of the housing 102 (as shown in FIG. 3) and the inside of the housing 102 for connection to the printing device 116 or any other devices inside the cabinet 100. Specifically, the printing device 116 and other electronics may be plugged into the power outlet 138, for example, from the inside of the housing 102. From the outside of the housing 102, an AC electrical power cord, which is plugged into a power source, may then be plugged into the power outlet 138. As shown in FIG. 3, the power outlet 138 on the outside of the housing 102 is a male connector (with two or three prongs) that is inset into the housing 102 so as to protect it from damage. At the interior of the housing 102, the outlet 138 is a female receptacle to accept the power plugs from the printing device 116 and other electrical components. The placement of ports 136 and power outlet 138 on the exterior surface of the cabinet 100 are advantageous in that the doors 122 (discussed below) need not be opened in order to plug and unplug the printing device 116, such as when the cabinet 100 is moved from one location to another.

As a portable unit, the cabinet 100 may operate on either AC electrical power (i.e., 110V AC in the U.S. or 220V AC globally) or battery power. In one embodiment, a battery (not shown) is located within the lower portion 120 of the cabinet 100 and is electrically connected to the power outlet 138. The battery may be of a type that would power the printing device 116 and one or more air filtration units 133 for a period of up to six hours. When not in use, the battery may be charged via electrical power delivered through the outlet 138.

The lower portion 120 of the printing cabinet 100 is located below the interior shelf 118 and may be used for storage of miscellaneous items such as sterilized paper. The lower portion 120 may be accessible to a user via one or more doors 122 fixed to any of the side(s) of the cabinet 100. As shown in FIGS. 1 and 2, the lower portion 120 has two doors 122 fixed to the front side 124 of the cabinet 100, although more than two doors may be included. The lower portion 120 may also house an air filtration unit (not shown) similar to the filtration unit 133 housed in the upper portion 114. As discussed herein, gaskets or seals may be utilized between the outer periphery of the door(s) 122 and the housing 102 to further ensure contamination protection.

In an alternative embodiment (not shown), the housing 102 is substantially enclosed, such that it has no openings or doors, except opening 129 where the printed paper passes into the paper tray 126. The presence of the air filtration unit 133 within the housing 102 maintains negative pressure within the cabinet 100, such that protection against contamination is ensured.

In practice, the printing device 116 and air filtration unit(s) 133 may be controlled via a wireless connection or hard wire connection to a network. According to one embodiment where hard wiring is used, a USB cable or an Ethernet cable may be connected from the PC to the ports 136, and then another cable may be connected from ports 136 to the printing device 116 on the inside of the housing 102. In another embodiment, any known wireless communication methods may be used, including, but not limited to, WiFi and Bluetooth® capabilities. Control of the printing device 116 may be accomplished within the cleanroom by any known wireless or wired devices, including, but not limited to, a network computer, an iPad®, a PC, or a laptop computer. When it receives a signal, the printing device 116 prints the required document and expels it into the paper tray 126 for collection by a user. The motor can activate the rollers 131, for instance, when the printing device 116 is activated. In an embodiment, the motor can have a wireless or wired connection and can receive the same signal as the printing device 116.

To further ensure the sterility of the cleanroom environment, the printing device 116 prints onto pre-sterilized paper. Any methods of sterilizing the paper known to one skilled in the art may be used, including, but not limited to, steam, heat, chemical treatment, or gamma irradiation. Preferably, a non-shedding paper product is used. In one embodiment, a plastic, non-shedding printing medium, such as Teslin® manufactured by PPG Industries of Pittsburgh, Pa., may be used. However, any suitable paper or printing medium can be used. The paper or printing medium may be provided on rolls at a predetermined length, or it may be provided as cut sheets prepared in ream. As set forth above, this paper may be stored in the lower portion 120 of the cabinet 100 when not in use.

The printing cabinet 100 is fully portable. All contents located within the cabinet 100 (e.g., printing device 116, air filtration unit 133) are enclosed within the housing 102. The printing cabinet 100 can be wheeled to other locations and plugged into any standard AC power source.

Figure 4:
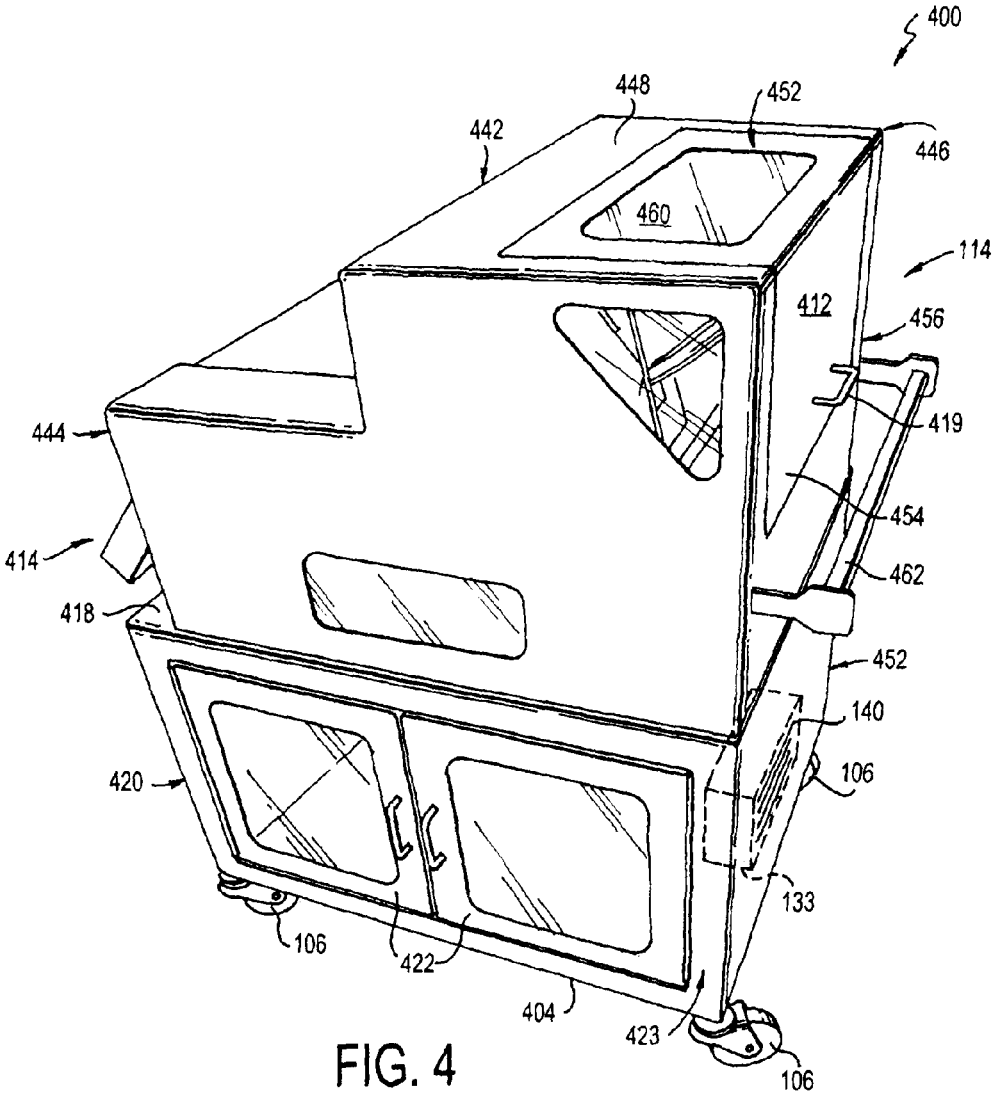
FIG. 4 is a front perspective view of a portable printing cabinet in accordance with an exemplary embodiment of the invention.
Figure 5B:
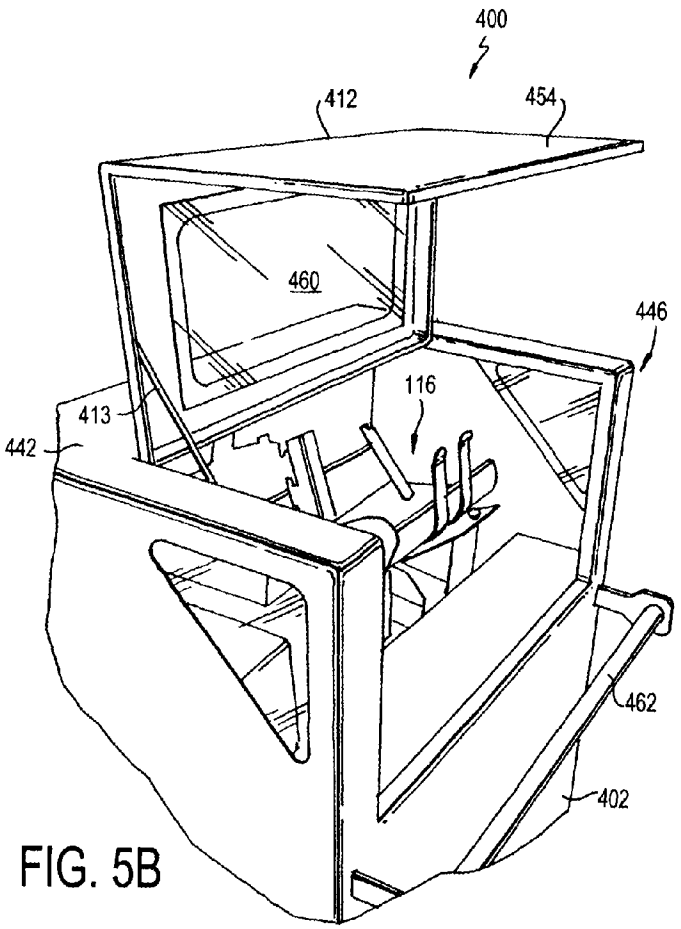
FIG. 5B is a cutout view of the front of the portable printing cabinet illustrated in FIG. 4 showing the paper tray in accordance with an exemplary embodiment of the invention.
Figure 5A:
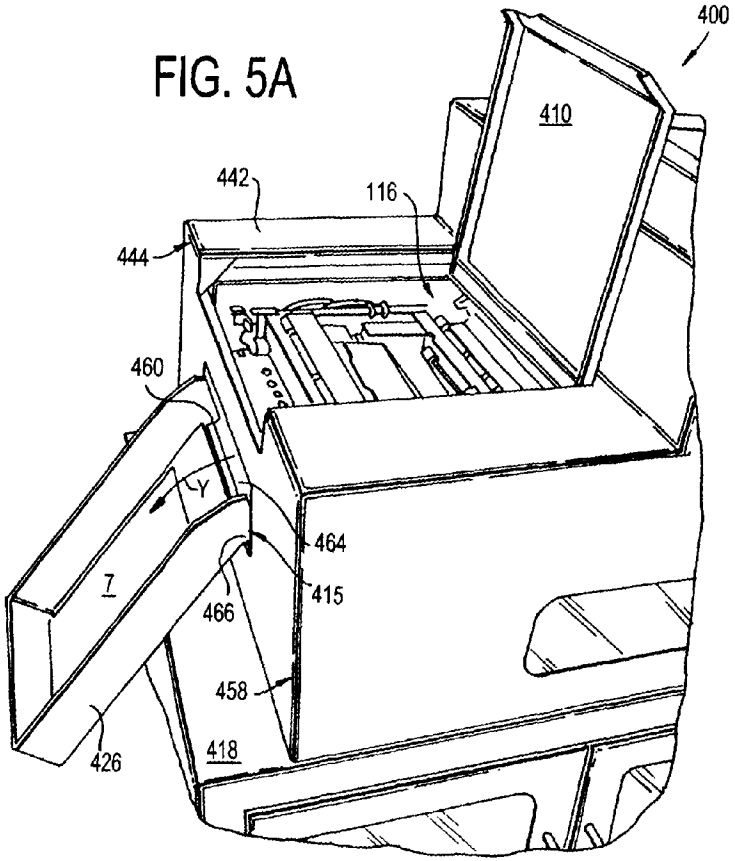
FIG. 5A is a cutout view of the front of the portable printing cabinet illustrated in FIG. 4, showing the hinged cover in an open position to provide access to the printing device in accordance with an exemplary embodiment of the invention.

Another embodiment of a portable printing cabinet 400 is illustrated in FIGS. 4 and 5A-B. In this embodiment, the printing cabinet 400 and its housing 402 generally have the same structure as printing cabinet 100, including at least four sides and a bottom surface, but the upper portion 414 of housing 402 has a different shape and design. Like cabinet 100, printing cabinet 400 is supported by a plurality of wheels 106 fixed to its bottom surface 404, which allows the cabinet 400 to be moved out of the cleanroom when necessary for cleaning or sterilization treatment. The housing 402 may be formed of the same material(s) as housing 102 and should form an enclosed unit to prevent contaminants from escaping.

The interior of the printing cabinet 400 is arranged similarly to the interior of cabinet 100, wherein an interior shelf 418 is provided that divides the cabinet 400 into an upper portion 414 and lower portion 420. The interior shelf 418 may be coupled to the housing 402 in the same manner as interior shelf 118 is to housing 102, as set forth above. The upper portion 414 houses the printing device 116 which is positioned on the interior shelf 418. The lower portion 420 may house at least one air filtration unit 133 aligned with vents 140 positioned on the outside of at least one side of the housing 402. The lower portion 420 may further include doors 422 on a front surface 423 thereof that allow for easy access to the storage area within the lower portion 420 and the air filtration unit 133.

In one embodiment, the upper portion 414 and lower portion 420 are designed as separate and discrete housings, each having a top, bottom, and four sides generally forming a substantially rectangular shape. The lower portion 420 can act as a base unit that supports the upper portion 414. The upper portion 414 can act as a printer unit that sits on the lower portion 420 and houses the printing device 116. In another embodiment, the lower portion 420 is optional and the upper portion 414 may house all components, including the printing device 116 and the at least one air filtration unit 133, and be supported by legs (not shown).

As shown in FIGS. 5A-B, the upper portion 414 has a top surface 442 and two opposing ends 444 and 446. The top surface 442 has a raised or step-up portion 448 (see FIG. 4) adjacent to end 446. The step-up portion 448 is raised because that end 446 receives the larger paper loading section of the printing device 116 which allows for large volumes of paper to be received therein.

Part of the step-up portion 448 is formed by at least one hinged cover 412, which is fixed to the housing 402 and encloses the upper portion 414 while allowing for easy access to the printing device 116. As best shown in FIG. 5B, the hinged cover 412 may be hinged to the housing 402 using any rotatable attachment mechanism know in the art, including piano style mechanical hinges. When the hinged cover 412 is lifted using the handle 419, access to the printing device 116 is provided so as to allow a user to feed paper into the printing device 116, fix paper jams, and the like.

The hinged cover 412 generally has an "L" shape formed by two joined surfaces 452 and 454. The top surface 452 forms part of the step-up portion 448, and side surface 454 forms part of a side 456 of the upper portion 414. The upper portion 414 also has an opposing side 458 at end 444. The top surface 452 may include a window 460, such as a glass window, so that the user can see the printing device 116 and ensure that it is working properly (e.g., to check paper levels) without having to open the hinged cover 412. While the air filtration unit 133 adequately maintains the interior of the cabinet 400 under negative pressure so as to minimize the risk of contamination, gaskets or rubber seals may optionally be utilized between the hinged cover 412 and the housing 402 to further ensure contamination protection. A bar 462 is fixed to the side 456 of the upper portion 414 of the housing 402 to assist the user in moving the printing cabinet 400.

As shown in FIG. 5A, a second hinged cover 410 forms a part of the top surface 442 of the upper portion 414 at end 444. The second hinged cover 410 encloses the upper portion 414 while also allowing for easy access to the dispensing end 415 (i.e., where the printed document is expelled) of the printing device 116. The second hinged cover 410 may be hinged to the housing 402 using any means set forth herein.

The first hinged cover 412 and second hinged cover 410 may remain in an opened position when opened by a user so that the user need not hold them in place while accessing the inside of the printing cabinet 400. For example, first hinged cover 412 may have a bar 413 that holds it open and/or a slow close mechanism (not shown) to avoid the first hinged cover 412 from slamming down onto the housing 402 when closed. The second hinged cover 410 may also include a bar and/or slow close mechanism.

A paper tray 426 is coupled to the side 458 of the upper portion 414 to receive printed paper Z being expelled from the printing device 116 in direction Y. As shown in FIG. 5A, side 458 of the upper portion 414 has a generally rectangular opening 464 formed therein. The opening 464 is aligned with and in communication with the printing device 116, specifically the area where the printed document is expelled from the printing device 116. Since the printing device 116 is inside the printing cabinet 400, the paper exits the printing device 116 and is directly expelled through the opening 464 to be received in the paper tray 426 on the outside of the printing cabinet 400. In one embodiment, the paper tray 426 includes at least two prongs 466 at one end thereof. The prongs 466 engage the side 458 at the opening 464 and function as hooks so as to hold the paper tray 426 in place when the weight of paper tray 426 is allowed to rest on the edge of opening 464. In this way, the paper tray 426 can be securely held in place at an angle extending toward the ground so as to allow the printed paper to slide down into the paper tray 426 in direction B when exiting through the opening 464. The paper tray 426 can also be easily removed to be cleaned, replaced, or to allow access to the opening 464. The paper tray 426 is sized and configured so as to be able to receive paper of various sizes and in large volumes. The paper tray 426 is generally formed of the same material used to form the housing 402 (e.g., stainless steel). In an alternative embodiment, the paper tray 426 need not be separate from the housing 402, but can be a lower part of the housing 402.

The printing cabinet 400 may further include ports and/or power outlets (not shown) such as those illustrated in FIG. 3. The ports and power outlets may be of any type and arrangement as set above. Moreover, the printing device 116 and air filtration unit(s) 133 may be controlled via a wireless connection or hard wire connection to a network as discussed herein.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed:

1. A printing cabinet for housing a printing device having a dispensing end that expels printed paper, comprising:

a housing having a substantially enclosed interior for receiving a printing device, the housing having a top surface and a bottom surface and opposing side surfaces each extending between the top surface and the bottom surface;

an opening formed in one of the opposing side surfaces of the housing, the opening aligned with the dispensing end of the printing device;

at least one L shaped hinged cover forming part of the top surface and providing access to the printing device;

a second hinged cover forming another part of the top surface and providing access to the dispensing end of the printing device; and a paper tray positioned outside of the housing and aligned with the opening of the housing to receive the printed paper expelled by the printing device, wherein the printing device is discrete from the housing and has a defined exterior surface.

2. The printing cabinet of claim 1, further comprising at least one hinged cover fixed to the housing.

3. The printing cabinet of claim 1, further comprising an interior shelf located within the housing defining an upper portion of the housing and a lower portion of the cabinet.

4. The printing cabinet of claim 3, wherein the upper portion of the housing includes a top surface having a step-up portion.

5. The printing cabinet of claim 4, wherein the at least one L-shaped hinged cover forms part of the step-up portion of the top surface of the upper portion of the housing.

6. The printing cabinet of claim 5, wherein the L-shaped hinged cover includes a window.

7. The printing cabinet of claim 1, further comprising at least one air filtration unit located within the housing and having at least one vent positioned on the outside of the housing.

8. The printing cabinet of claim 7, wherein the at least one air filtration unit comprises a fan which forces air from the interior of the housing to the outside of the housing through the at least one vent.

9. The printing cabinet of claim 7, further comprising a second air filtration unit located within the housing and having vents positioned on the outside of the housing.

10. The printing cabinet of claim 1, wherein the housing is made of stainless steel.

11. The printing cabinet of claim 1, further comprising at least one door fixed to the housing.

12. The printing cabinet of claim 1, further comprising a plurality of wheels fixed to a bottom surface of the housing and a handle fixed to a side of the housing such that the printing cabinet is portable.

13. The printing cabinet of claim 1, further comprising at least one data connection port located on the housing.

14. The printing cabinet of claim 1, further comprising a power outlet located on the housing.

15. The printing cabinet of claim 14, further comprising a battery located within the housing and being electrically connected to the power outlet.

16. The printing cabinet of claim 1, wherein the paper tray includes at least two prongs at one end for engaging with the opening of the housing and removably engaging the paper tray thereto.

17. A printing cabinet, comprising:

a housing having a substantially enclosed interior and an opening formed a side surface thereof;

an interior shelf located within the housing defining an upper portion and a lower portion of the cabinet, wherein the upper portion has a top surface with a step-up portion;

a paper tray positioned outside of the housing and in communication with the opening of the housing;

at least one L-shaped hinged cover that forms part of the step-up portion; of the top surface of the upper portion of the housing;

a second hinged cover fixed to the top surface of the upper portion of the housing adjacent to the step-up portion;

at least one air filtration unit located within the housing having vents positioned on an outside surface of the housing; and at least one power source.

* * * * *